US006311422B1

(12) United States Patent
Exum et al.

(10) Patent No.: US 6,311,422 B1
(45) Date of Patent: Nov. 6, 2001

(54) GUN LOCK

(76) Inventors: Lynn Exum; Brock Smith, both of 10641 Highway 412 West, Paragould, AR (US) 72450

( * ) Notice: Subject to any disclaimer, the term of this patent is extended or adjusted under 35 U.S.C. 154(b) by 0 days.

(21) Appl. No.: 09/372,911

(22) Filed: Aug. 12, 1999

(51) Int. Cl.[7] ..... F41A 17/00
(52) U.S. Cl. ..... 42/70.11
(58) Field of Search ..... 42/70.11

(56) References Cited

U.S. PATENT DOCUMENTS 4,224,753 * 9/1980 Bielman ..... 42/70.11
4,512,099 * 4/1985 Mathew ..... 42/1
5,048,211 * 9/1991 Hepp ..... 42/70.11
5,062,233 * 11/1991 Brown ..... 42/70.11
5,233,777 * 8/1993 Waterman, Jr. et al. ..... 42/70.11
5,241,770 * 9/1993 Lambert ..... 42/70.11
5,664,358 * 9/1997 Haber et al. ..... 42/70.11
5,918,403 * 7/1999 Lurz, Jr. et al. ..... 42/70.11

* cited by examiner

*Primary Examiner*—Charles T. Jordan
*Assistant Examiner*—Denise J Buckley

(57) ABSTRACT

A device for preventing the loading and discharge of a gun, comprising cooperating means for obstructing the positioning of ammunition into the firing chamber of a gun, means for activating said obstruction means, and means for locking said obstruction means in said obstruction position; also, a method of making and using such a gun lock device.

15 Claims, 6 Drawing Sheets

GUN LOCK

CROSS REFERENCES TO RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION (1) Field of the Invention.

The claims of this invention are to be read to include any legally equivalent gun lock or method of using same. The invention generally relates to the field of gun locking devices. More particular, the invention relates to devices preventing the loading or discharging of a firearm.

(2) Description of the Related Art Including Information Disclosed Under 37 C.F.R. 1.97 and 1.98.

There are many patented locking devices, such as the following:

| PatentNumber | | |
|---|---|---|
| 2,479,107 | 5,048,211 | 5,289,653 |
| 4,512,099 | 5,115,589 | 5,699,687 |
| | 5,241,770 | |

| Inventor | Issued |
|---|---|
| Garretson | Aug. 16, 1949 |
| Mathew | Apr. 13, 1985 |
| Hepp | Sept. 17, 1991 |
| Shuker | May 26, 1992 |
| Lambert | Sept. 7, 1993 |
| Szebeni et al. | Mar. 1, 1994 |
| Pittman | Dec. 23, 1997 |

The patent issued to Mathew discloses an end barrel cylinder lock having special cams attached to a tube and a coaxially actuating rod extending through the tube; turning a key within the cylinder lock 90 degrees causes rotation of the rod through the tube, resulting in lateral displacement of a diagonally split sleeve. Although this invention is superficially similar to the invention disclosed herein, there are several significant differences. For example, the Mathew device is designed so that lateral displacement of the diagonally split sleeve engages an "inclined face" within the gun barrel, causing the foremost wedge of the split sleeve to "abut the walls of the tapered throat, thereby locking the device in place." (Mathew, Column 4, lines 16 through 19.) As will be disclosed more fully hereinbelow, the locking mechanism of the present invention is enhanced by dual action: (a) the foremost wedge of the terminal split-sleeve element is lodged against a pronounced ledge at the foremost end of the firing chamber, where the rim of a casing for a bullet or shell normally is situated when the firearm is loaded and ready for firing (so that said casing is held in the proper position to be impacted by the firing pin or similar firing mechanism); and (b) lateral displacement of the terminal split-sleeve element causes the lateral portions of each sleeve element to press against the interior wall(s) of the firing chamber. The Mathew device also differs in that the axial rod transverses through an axial bore through the intermediate split-sleeve element, which essentially floats loosely along the rod between the terminal split-sleeve element and the tube; such loose construction and variable positioning at the critical point of contact with the chamber or barrel increases the prospects that the Mathew locking device will be misaligned or otherwise malfunction. It is also noteworthy that the terminal wedge of the Mathew lock is anchored to the rod by means of a hollow pin extended through the lateral portions of the terminal wedge; the ends of those pins may scar or otherwise damage the interior of the chamber or barrel, and otherwise make such an attachment unsuitable for augmenting the locking mechanism by applying pressure against the interior walls of the firing chamber.

Several disadvantages of the Mathew locking device are attributable to the mere 90 degree rotation required to unlock the device. Although such limited rotation arguably expedites the locking of the device, such limited rotation also expedites the unlocking process; such a short required rotation enhances the prospect that the device may be removed accidentally, or by minors, thereby greatly diminishing the practical utility of the Mathew lock. Another disadvantage of the Mathew lock is the relatively limited number of firearms it may be used with, due to the limited length of longitudinal displacement or travel caused by the mere 90 degree rotation of the key within the cylinder lock. For a locking device to be useful in a variety of different firearms, the varied lengths of many different firearm barrels (and the varied constructions of the juncture between the chamber and the barrel) requires the locking device to be capable of accomplishing a greater distance of longitudinal displacement or travel than can be accomplished through a mere one-quarter turn. This is because of the different specifications and variances between different firearm chambers and barrels, and the juncture thereof. For example, the area and distance between the ledge and the rifling, an area also known as the headspace, varies dramatically for different makes of firearms, and for different types of firearms (such as automatic pistols and revolvers) made by the same manufacturer. The Mathews lock is made for a revolver having little headspace, and it would not work well (without substantial modification) for an automatic pistol having materially greater head space. The Mathew lock will work for particular types of pistols having headspace and other internal dimensions within a narrow range, but not for firearms having headspace necessitating a greater distance of longitudinal travel imparted by a mere one-quarter turn. Alternatively, due to the wear and tear of repeated use, the Mathew caming mechanism may be loosened up or expanded, thereby causing the 90 degree rotation to have insufficient overall travel to displace the after wedge for a positive locking force. Lastly in this regard, since the Mathew lock may not fully occupy the firing chamber, especially of older firearms (such as a .357) capable of using short cartridges (such as, for example, a .38 caliber), the Mathew device may not prevent all ammunition from being loaded into the chamber, and the possible discharge of such ammunition within the chamber. Similarly, the failure of the Mathew device to abut against any ledge at the juncture between the chamber and the barrel might make it easier to remove the locking device by a punch apparatus extending through the open chamber and forcing the locking device down the barrel.

The invention patented by Garrets on suffers from some of the disadvantages described hereinabove concerning the Mathew locking device. The Garrets on invention locks into the firing chamber merely by the lateral projection of locking pins into contact with the inner wall of the chamber, actuated by a 180 degree rotation of the lock rod by turning a key one-half a rotation. The Garrets on device does not disclose a device utilizing both pressure against the chamber wall, and lodging against a ledge at the juncture of the chamber and barrel.

BRIEF SUMMARY OF THE INVENTION

In general, this application pertains to a device for preventing the loading and discharge of a gun, comprising cooperating means for obstructing the positioning of ammunition into the firing chamber of a gun, means for activating said obstruction means, and means for locking said obstruction means in said obstruction position. The invention disclosed herein also generally pertains to a method of making and using such a gun lock device.

BRIEF DESCRIPTION OF THE SEVERAL VIEWS OF THE DRAWINGS

The following describes the drawings accompanying this application, which are incorporated herein.

Figure 1:
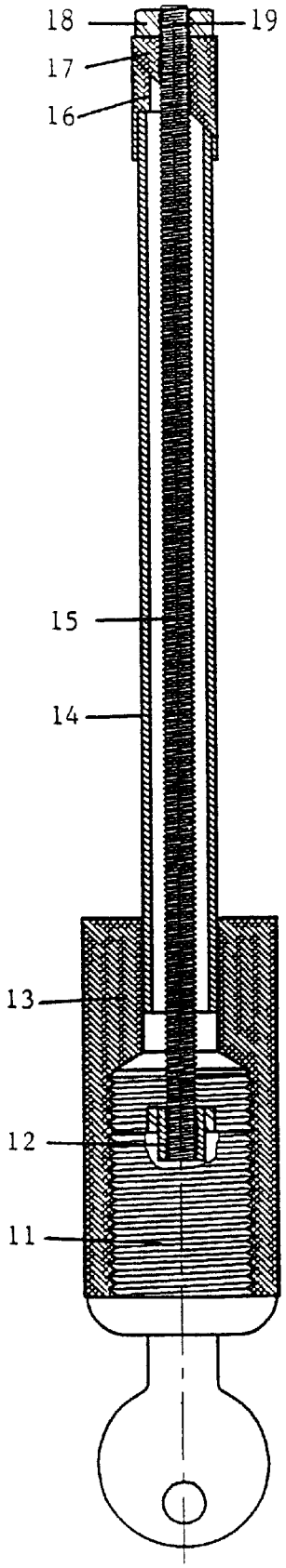
FIG. 1 depicts a cross sectional view of the device in an insertion configuration, sectioned along a centrally located longitudinal axis, including a muzzle stop (13)/lock element (11), activating means (15) within a bridge element (14), obstruction means having an intermediate obstructor (16) and terminal obstructor (17), and a terminal stop means (18); also depicted are a functional (rotary) connection (12) between the activating means (activator rod, 15) and the locking means (rotary cylinder lock, 11), as well as a terminal stop means (lock nut, 18) thread ably received on the external threads at the rearmost end (19) of the activator rod, and the functional (threaded) connection of the terminal obstructor (17) on said external threads. (The dashed line extending from the rearmost end of the activator rod through the lock and key depicts another hypothetical longitudinal axis, essentially perpendicular to the bisection plane.)

These drawings illustrate certain details of certain embodiments; the invention disclosed herein is not limited to only the embodiments so illustrated. The invention disclosed herein may have equally effective or legally equivalent embodiments.

DETAILED DESCRIPTION OF THE INVENTION

For the sake of simplicity and to give the claims of this patent application the broadest interpretation and construction possible, the following definitions will apply:

1. The word "axial" or similar term means of, related to, or along a hypothetical or imaginary axis; the word "coaxial" or similar term means having a common axis.
2. The phrase "diagonally split" means sharing essentially interfacing facets oriented to resemble a cross-section divide sectioned in the range of between about 15° and 75°, but preferably close to 45°.
3. The word "forward" or similar term means toward the muzzle end of the gun, relative to the point of reference stated, implied or inherent in the context of the usage of said word; the word "foremost" or similar term may mean the furthest toward the muzzle end of the gun, relative to the point of reference stated, implied or inherent in the context of the usage of said word.
4. The word "rearward" or similar term means toward the grip, stock or other area of the gun opposite the muzzle end, relative to the point of reference stated, implied or inherent in the context of the usage of said word; the word "rearmost" or similar term may mean the furthest toward the rearward end of the gun, relative to the point of reference stated, implied or inherent in the context of the usage of said word.
5. The phrase "remotely activating" means activation from outside the area of lodging within the firing chamber, usually from immediately outside the muzzle.
6. The word "truncate" or a similar term means appearing to have been cross-sectioned or cleaved diagonally through a hypothetical or imaginary axis.
7. The phrase "functionally connected" or a similar phrase, means to be connected in such a way to at least fulfill the function stated, implied or inherent in the context of usage; as an example, functional connection of an activator rod that activates an obstructor by axial rotation may be satisfied by any means of coupling one end of said rod to a rotary activation means (i.e., rotational connection, or coupling providing transfer of rotary force) while the other end is functionally connected to an obstructor (such as, for example, allowing the terminal obstructor to travel forewardly with the appropriate rotation).

8. The phrase "stop means" or a similar phrase means to prevent either the entry to or exit from a place or position stated, implied or inherent in the context of usage; for example, an "obstructor stop" may mean something preventing exiting of said obstructor from a rearmost end of an activator rod, whereas a "muzzle stop" may mean something preventing entry of an activator means (or portion thereof) into the muzzle of a gun barrel.

Also for the sake of simplicity, the conjunctive "and" in the Detailed Description of the Invention may also be taken to include the disjunctive "or," and vice versa, whenever necessary to give the claims specification of this patent application the broadest interpretation and construction possible. Likewise, when the plural form is used, it may be taken to include the singular form, and vice versa.

The invention disclosed herein is not limited by construction materials to the extent that such materials satisfy the structural or functional requirements; for example, any materials may be used to make obstruction means so long as such materials fulfill the requirements that the obstruction means be able to contact the wall(s) of the firing chamber and/or lodge against the ammunition rim ledge or other stop means, with sufficient force and rigidity to prevent dislodging from the firing chamber. Preferred versions of the invention disclosed herein are primarily constructed from materials such as aluminum, steel, titanium, brass, copper, pvc resins, members of the polypropylene class of polymers and alloys and other combinations thereof.

Most conventional firearms are comprised of a firing chamber that leads down into a gun barrel and out the muzzle of the gun. For firing a gun, ammunition is positioned in the firing chamber so that it is held in place while a firing pin, hammer or similar mechanism strikes a primer, usually on the rearward most facet of the ammunition, causing the further ignition of gun powder contained in the casing of the ammunition, the ignition of which propels the ammunition's projectile(s) through the gun barrel and out the muzzle. Most guns have a variety of distinct differences from other guns, and there may even be distinct differences between different models of essentially the same gun. Such areas of difference or variety include: barrel length (from a "snub nose" to a "long rifle"); barrel choke (convergence of barrel bore diameter, toward the muzzle); barrel rifling (pattern of grooves and "lands" between the grooves, on the inner barrel wall); ammunition positioning for firing, and method of positioning (muzzle loading, manual insertion of cartridge, automatic mechanical insertion following ejection of cartridge); headspace, or distance from a place along the ammunition (often the rearmost face of the ammunition) to the bolt (or breech block) in the fully locked position; method of discharging the ammunition for firing (centrally positioned base primer for center firing ammunition, peripherally positioned base primer for rim firing ammunition); and method of ejection of cartridge after firing (manual removal, pump ejection, automatic mechanical ejection).

One area of difference material to the invention disclosed herein includes the manner of positioning ammunition for firing, and the dimensions of the juncture of the firing chamber and the barrel. Although the present invention may be useful in firearms of almost any type, it is especially useful in guns for firing ammunition (shells or cartridges) having an annular rim or belt (or similar flange, collectively the "rim") concentrically outstanding from the (rearward) firing base of the shells or cartridges. For lodging such ammunition in the gun for firing, wherein the ammunition is often described as being "fully chambered," the shell or cartridge is commonly positioned so that the forwards face of said rim lodges against a ledge-like upstanding on the inner surface of the chamber barrel area, formed at the juncture of the firing chamber and the barrel (where the bore diameter of the firing chamber reduces essentially instantaneously to the relatively smaller diameter of the bore of the barrel), with the body of the shell or cartridge extending forewardly into the barrel and awaiting discharge. The lodging of the ammunition in the barrel, with the forward face of the ammunition's base rim lodged against the essentially circumferential upstanding ledge, provides the ammunition with the necessary resistance (or stop) to result in discharge of the ammunition when the base primer is struck by the firing pin, hammer or similar firing mechanism of the gun. The invention disclosed herein uses that ledge or other stop means as one manner of preventing ammunition from being positioned in the chamber for firing, and as one manner of preventing premature removal of the locking device. Regardless of the type of ammunition used by a firearm, the present invention may be locked into place to prevent positioning of ammunition, and it continues doing so (while occupying the headspace) until unlocked and removed; the present invention expands against the chamber shoulders, the chamber headspace end, and any outstanding ledge-like protrusions or tapered contours of the chamber.

FIG. 1 depicts a cross sectional view of the device in an insertion configuration, sectioned along a centrally located longitudinal axis, including a muzzle stop (13)/lock element (11), activating means (15) within a bridge element (14), obstruction means having an intermediate obstructor (16) and a terminal obstructor (17), and a terminal stop means (18); also depicted are a functional (rotary) connection (12) between the activating means (activator rod, 15) and the locking means (rotary cylinder lock, 11), as well as a terminal stop means (lock nut, 18) thread ably received on the external threads at the rearmost end (19) of the activator rod, and the functional (threaded) connection of the terminal obstructor (17) on said external threads. (The dashed line extending from the rearmost end of the activator rod through the lock and key depicts another hypothetical longitudinal axis, essentially perpendicular to the bisection plane.)

Figure 2:
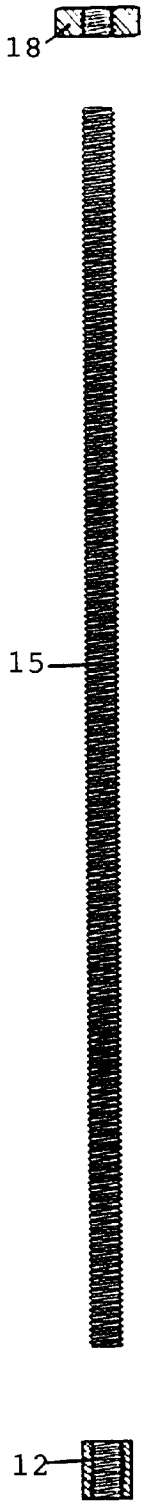
FIG. 2 depicts an exploded view of an activating means, terminal stop means and functional connection means of the activating means, including an activator rod (15) having external threads at least at a rearmost end, a lock nut (18) thread ably received thereon, and a functional attachment means (12) comprised of a coupling means between the rearmost end of the cylinder and the foremost end of the activator rod.

FIG. 2 depicts an exploded view of an activating means, terminal stop means and functional connection means of the activating means, including an activator rod (15) having external threads at least at a rearmost end, a lock nut (18) thread ably received thereon, and a functional attachment means (12) comprised of a coupling means between the rearmost end of the cylinder and the foremost end of the activator rod.

Figure 3:
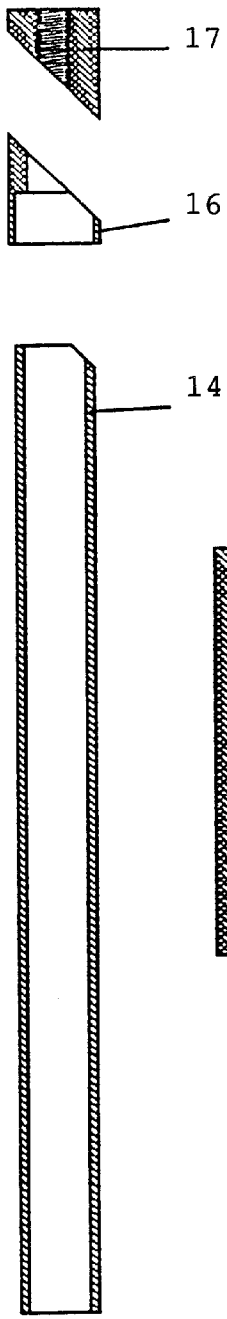
FIG. 3 depicts an exploded view of an obstruction means and bridge element, including a terminal obstructor (17), an intermediate obstructor (16) and a bridge tube (14).

FIG. 3 depicts an exploded view of an obstruction means and bridge element, including a terminal obstructor (17), an intermediate obstructor (16) and a bridge tube (14).

Figure 4:
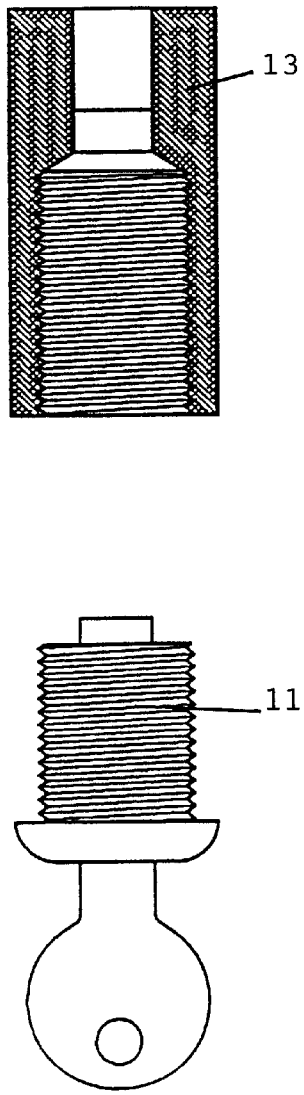
FIG. 4 depicts an exploded view of a muzzle stop lock means, including a muzzle stop means (13) and a locking means (11); in this version, the locking means may be positioned within the internal bore of the stop means by threading and/or adhesion mechanisms.

FIG. 4 depicts an exploded view of a muzzle stop lock means, including a muzzle stop means (13) and a locking means (11); in this version, the locking means may be positioned within the internal bore of the stop means by threading and/or adhesion mechanisms.

Figure 5:
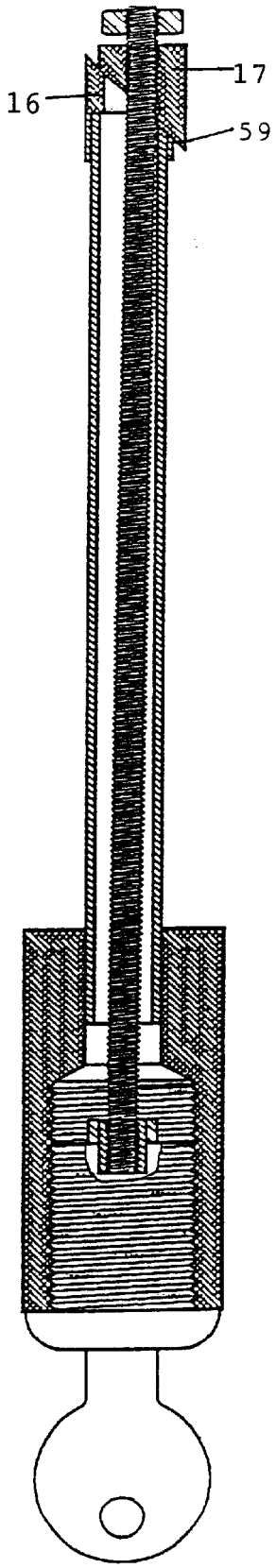
FIG. 5 depicts a cross sectional view of the device in a locking configuration, sectioned along a centrally located longitudinal axis, including lateral displacement of a terminal obstructor (17) relative to an intermediate obstructor (16), resulting in the increase of the combined cross-sectional dimension sufficient for said obstruction means to contact the inner wall(s) of the firing chamber; also included is a diagonal interface of said terminal obstructor having a foremost aspect essentially terminating in an apical facet (59) adapted for lodging forewardly against the ammunition rim ledge or other stop means of the gun.

FIG. 5 depicts a cross sectional view of the device in a locking configuration, sectioned along a centrally located longitudinal axis, including lateral displacement of a terminal obstructor (17) relative to an intermediate obstructor (16), resulting in the increase of the combined cross-sectional dimension sufficient for said obstruction means to contact the inner wall(s) of the firing chamber; also included is a diagonal interface of said terminal obstructor having a foremost aspect essentially terminating in an apical facet (59) adapted for lodging forewardly against the ammunition rim ledge or other stop means of the gun.

Figure 6:
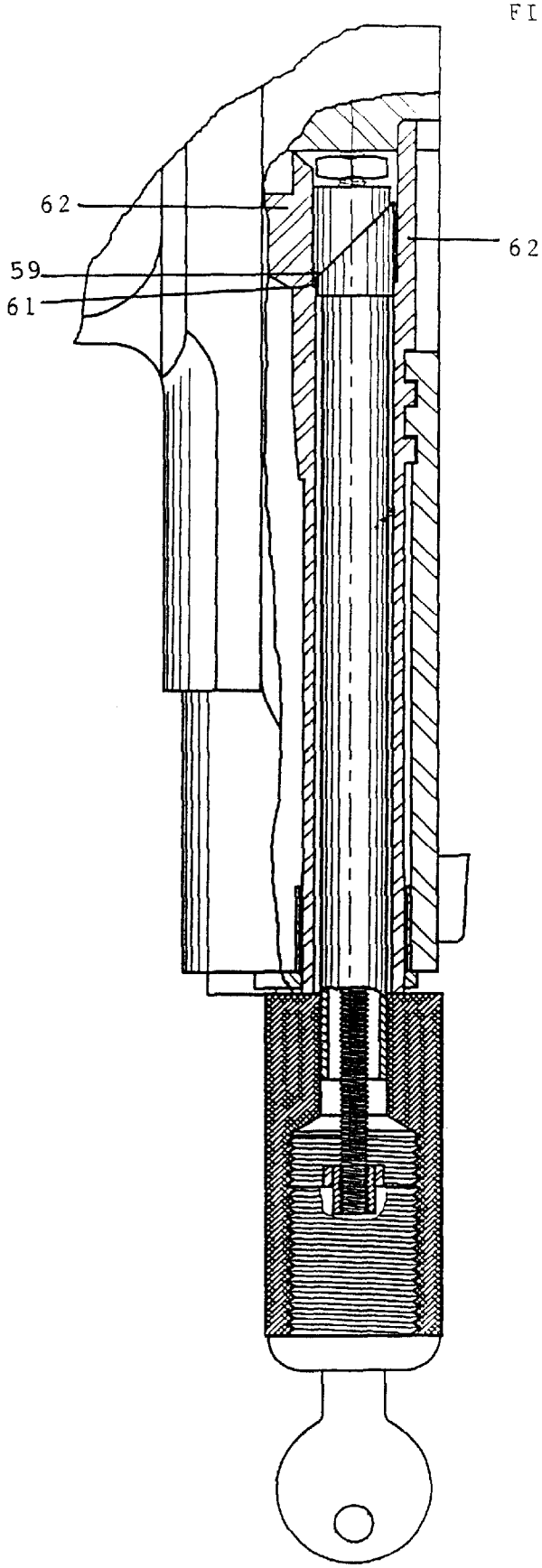
FIG. 6 depicts a cut away view of a locking device in a locked position within a pistol or firearm having a similar internal configuration; note the apical facet (59) lodged forewardly against the ammunition rim ledge or other stop means (61), and the wall(s) of the firing chamber 62.

FIG. 6 depicts a cut away view of a locking device in a locked position within a pistol or firearm having a similar internal configuration; note the apical facet (59) lodged forewardly against the ammunition rim ledge or other stop means (61), and the wall(s) of the firing chamber 62.

In its most general form, the locking device disclose herein has the following basic elements: means for physically obstructing positioning of ammunition in the firing chamber of a gun; means for remotely activating said physical obstruction; and means for locking said physical obstruction means in said obstructing position. In one version of the invention, said obstruction means includes a member that fits into the firing chamber, and changes its alignment or configuration so that it essentially comes into pressing contact with the inner wall(s) of the firing chamber and lodges against a ledge or other stop means at or near the juncture of the firing chamber and the gun barrel. The means for remotely activating said obstruction means includes a rod extending from said obstruction means through the gun barrel and connecting to a rotary activation means; an essentially hollow tube may surround said rod and provide structural rigidity and strength to said activation means, especially if attached at opposite ends to said rotary activation means and to said obstruction means. Rotation of said rotary activation means causes corresponding rotation of said rod, which causes the alignment or configuration of said obstruction means to change and to thereby physically prevent positioning of ammunition in the gun for firing. The means for locking said obstruction means in said obstructing position may include an enclosed cylinder lock attached to the forwards end of said tube, and to the foremost end of said rod in such a manner that rotation of the key inside said lock causes the corresponding rotation of said rod for activation of said obstruction means. In using the locking device, the obstruction means is inserted (via the rod and/or tube) down the muzzle, through the barrel and into the firing chamber; when properly sized and configured, the rearward facet of the locking means will abut against the muzzle when the inserted obstruction means is in position to (upon activation) lodge against the ledge or other stop means, and expand against the inner wall of the firing chamber. Activation occurs by turning the key withing the locking means, at least one complete 360° rotation (and preferably more rotations); the more rotations the key turns, the greater the longitudinal travel and the change in alignment and configuration of the obstruction means, and the better the resulting obstruction. The device is locked into the gun in its loading-obstruction or discharge-prevention position by removing the key from the locking means. Unlocking the device requires insertion of the key, followed by reverse rotation, and the greater the number of rotations, the lesser the likelihood that the device will unlock accidentally, or be unlocked by toddlers or other minors.

One version of the invention is a device for preventing discharge of a gun, comprising means for physically obstructing positioning of ammunition in the firing chamber of the gun; means for activating said physical obstruction means; and means for locking said physical obstruction means in said obstructing position, and unlocking same. Said obstruction means may include a terminal obstructor and an intermediate obstructor. Moreover, said activation means may include a muzzle stop activator in functional communication with said terminal obstructor.

Said obstruction means may include at least one terminal obstructor and at least one intermediate obstructor that, upon said activation, contacts the inner wall(s) of the firing chamber and lodges forewardly against the ammunition rim ledge or other stop means of the gun. In one more particular version of the invention, said obstruction means comprises a terminal obstructor and a cooperating intermediate obstructor, both having an essentially cylindrical cross-sectional configuration and cooperative alignment, both having at least one cooperating interface that, upon said activation, facilitates lateral displacement of said terminal obstructor relative to said intermediate obstructor; this results in the increase of the combined cross-sectional dimension sufficient for said obstruction means to contact the inner wall(s) of the firing chamber and for said terminal obstructor to lodge forewardly against the ammunition rim ledge of the gun.

Said intermediate obstructor may be comprised of a right circular cylinder having a forwards closed end, and a rearward end comprising an essentially diagonally truncated interface; said closed end adapted for anchoring to said bridge element rearward end, said closed end also defining a port for passage of said activator rod. Said terminal obstructor may be comprised of a right circular cylinder having a rearward closed end, and a forwards end comprising an essentially diagonally truncated interface. Said closed end may define an aperture for accepting said activator rod rearmost end; in one version, said aperture in said terminal obstructor rearward closed end is a threaded bore, and said activator rod includes external threads acceptable to said threaded bore, at least on a sufficient portion of its rearmost end for allowing functional communication with said terminal obstructor (and perhaps a stop means on the end of said activator rod). The diagonal interface of said terminal obstructor having a foremost aspect essentially terminating in an apical facet adapted for lodging forewardly against the ammunition rim ledge or other stop means of the gun. Each of said diagonal interfaces may be aligned in cooperating relationship so that, when said activation causes said terminal obstructor to travel forwards, said terminal diagonal interface contacts said intermediate diagonal interface, and continues traveling with said activation until said terminal apical facet extends forewardly along said activator rod external threads until essentially breaking the circumferential or other outer plane of the intermediate obstructor, thereby essentially jutting outside the surface of said intermediate obstructor.

The aforementioned muzzle stop activator may be comprised of an activation means (such as, for example, a rotary cylinder) functionally connected to an activator rod foremost end, and anchored to a bridge element forwards end (such as, for example, the forwards end of a tube). Functional connection of said activator rod foremost end and said activation means may be accomplished by almost any suitable coupler means that result in essentially permanent coupling; for example, such means may be selected from the group consisting of welding, adhesion, bolting, pinning, and combinations thereof. For example, the rearward end of a rotary cylinder lock may define a bore channel adapted to accept insertion of an internally threaded piece, and the outer surface of said insertion piece may be coupled to the inner surface of said bore channel by adhesives and/or solder or welding and/or via a bolt or pin extending inwardly through said cylinder lock to lodge against the outer surface of said insertion piece; the external surface of the insertion piece may also be knurled or otherwise roughened to facilitate such coupling. The internal threads of the insertion piece may then accept the external threads of an activator rod, essentially screwed into the insertion piece until essentially locked in position; alternatively, the coupling of the activator rod within the insertion piece may be augmented with any of the aforementioned means, especially adhesives.

The aforementioned activation means may include a rotational cylinder lock having an insertion key, the rotation of which causes corresponding rotation of said activator rod, which in turn causes said obstructor to travel forwards on said external threads. Said locking means may include a cylinder lock having a removable insertion key, the rotation of which causes rotation of said activator rod, which in turn causes said obstructor to travel forwards, said removal causing said obstruction means to be locked said obstructing position.

Figure 8:
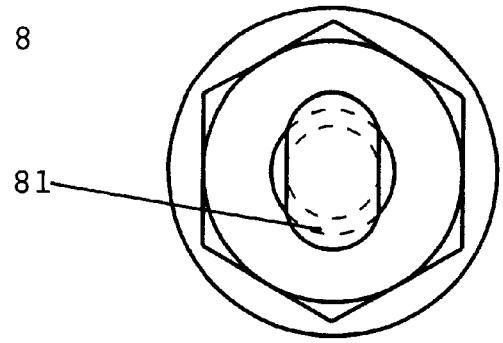
FIG. 8 depicts a cross sectional view of a device, sectioned at the plane shown as line 80 in FIG. 7.
Figure 7:
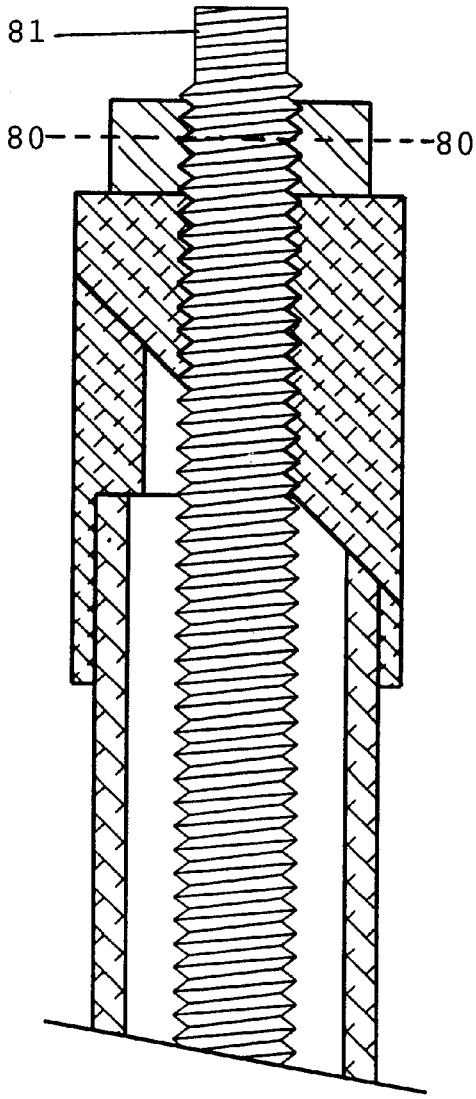
FIG. 7 depicts a cut away view of a terminal portion of a locking device, including a flared end (81) of the activator rod; flaring may be accomplished by flattening a terminal section of threads, either after the positioning of a terminal nut (as depicted) or in lieu of a terminal nut.
Figure 10:
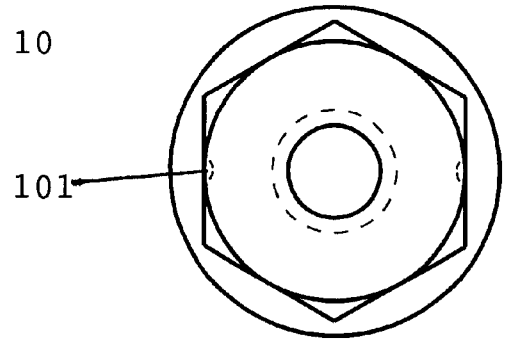
FIG. 10 depicts a cross sectional view of a device, sectioned at the plane shown as line 100 in FIG. 9.
Figure 9:
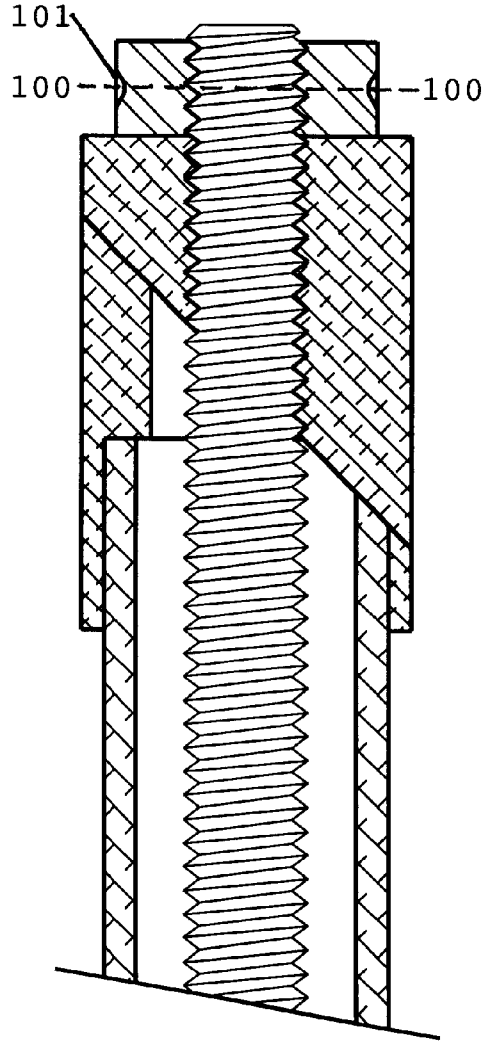
FIG. 9 depicts a cut away view of a terminal portion of a locking device, including a crimped ended (101 of FIG. 9) activator rod; the force exerted to crimp the nut causes depressions or dimples thereon, and otherwise deforms the nut threads to hinder or prevent removal of the nut.
Figure 12:
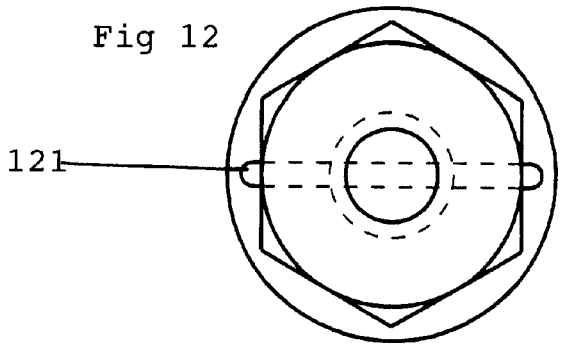
FIG. 12 depicts a cross sectional view of a device, sectioned at the plane shown as line 120 in FIG. 11.
Figure 11:
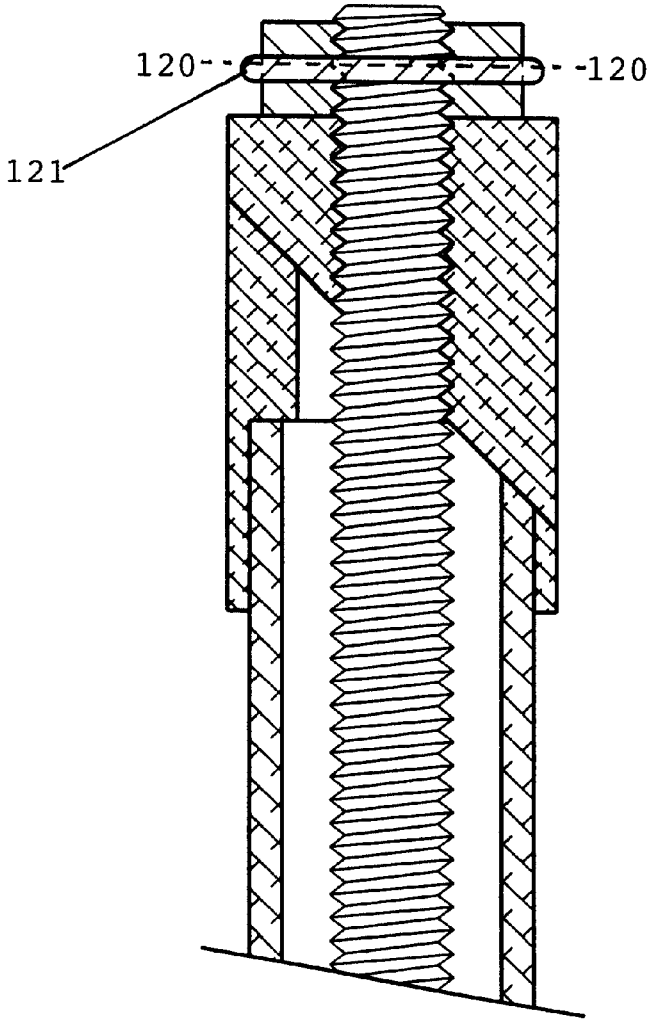
FIG. 11 depicts a cut away view of a terminal portion of a locking device, including a pin (121) transversing through a bore drilled through a nut and threaded rod.

To prevent a terminal obstructor from falling off the end of an activator rod when said rod has been rotated in that direction, it may be advantageous to provide the end of the rod with an obstructor stop means. Said obstructor stop means may include almost any appropriate means of preventing the departure of the obstructor from the activation means; for example, such means may be selected from the group consisting of a flared end (81 of FIG. 7 and FIG. 8) of the activator rod, a crimped ended (101 of FIG. 9 and FIG. 10) activator rod, one or more terminal roll pins (121 of FIG. 11 and FIG. 12), a terminal lock nut, or methods of disrupting the rotation of the obstructor off the activator means (such as using corrosives and/or adhesives on the threads of an activator rod), and combinations thereof.

One of the important characteristics common to each of said members in said group, supporting the inclusion of each member in said particular group, is that each fulfills the function of preventing the exit of the terminal obstructor from the activator rod. Most particularly, said stop means is a lock nut essentially permanently anchored to said rearmost end of said activator rod.

One particular embodiment of the device for preventing discharge of a gun comprises a removable key inserted within a rotary cylinder lock rotationally connected to an activator rod extending through an intermediate obstructor port and threading through a terminal obstructor aperture while terminating with a lock nut. Said cylinder is also attached to a bridge tube substantially housing said activator rod and anchoring said intermediate obstructor. Said terminal obstructor is comprised of a right circular cylinder having a rearward closed end, and a forwards end comprising an essentially diagonally truncated interface. The closed end of said terminal obstructor defines an aperture having a threaded bore for accepting at least a rearmost end of said activator rod including external threads acceptable to said threaded bore. Said rearmost end of said activator rod has said terminal lock nut essentially permanently anchored thereto. The diagonal interface of said terminal obstructor has a foremost aspect essentially terminating in an apical facet adapted for lodging forewardly against the ledge of the ammunition rim ledge of a gun. In said embodiment, said intermediate obstructor is comprised of a right circular cylinder having a forwards closed end, and a rearward end comprising an essentially diagonally truncated interface. Said closed end is adapted for anchoring to a rearward end of said bridge tube substantially housing said activator rod. Said closed end also defines a port for passage of said activator rod.

In this embodiment, said rotary cylinder lock accepts said removable insertion key. Moreover, to act as a muzzle stop, said cylinder lock has a diameter greater than the bore diameter at the gun muzzle. It is also anchored at a rearward end to a forwards end of said bridge tube, having a rear wall end anchored to said forwards end of said intermediate obstructor. Said activator rod is rotationally connected at a forwards end to said rotary cylinder, extending through said intermediate obstructor port and threading through said terminal obstructor aperture while terminating with said lock nut. The rotation of said rotary cylinder (such as, for example, by the turning of a key) causes corresponding rotation of said activator rod, which in turn causes said terminal obstructor to travel forward on said external threads. In an initial insertion configuration, each of said obstructor diagonal interfaces aligns in cooperating relationship; when said rotation causes said terminal obstructor to travel forward, the terminal diagonal interface contacts said intermediate diagonal interface, and continues traveling with said rotation until said terminal apical facet extends forwardly outside the surface of said intermediate obstructor, thereby causing the device to assume an obstructing position. Removal of said key causes said obstructors to be locked in said obstructing position.

Besides the device described herein, the invention includes a method of making such a device. One general version of the method comprises the steps of functionally connecting a physical obstruction means to a means for activating said physical obstruction, and functionally connecting a means for locking or unlocking same. Said functional connection of said physical obstruction means may be comprised of: providing a removable key for operation of, insertion within and removal from, a rotary cylinder lock; rotationally connecting a rotary activation cylinder to an activator rod extending through an intermediate obstructor port and threading through a terminal obstructor aperture while terminating with a lock nut; and also attaching a non-rotational portion of said cylinder to a bridge tube substantially housing said activator rod and anchoring said intermediate obstructor.

Besides the method of making the device described herein, the invention includes a method of using such a device for preventing discharge of a gun. One general version of the method of use comprises the steps of inserting obstruction means in an insertion configuration down a gun barrel muzzle, activating said obstruction means (so that said obstruction means assumes an obstructing configuration and prevents the loading of ammunition into the gun firing chamber), and locking said obstruction means in said obstructing position. Said device may be positioned so that said activated obstruction means contact the wall(s) of the firing chamber, and/or said activated obstruction means lodge (especially the foremost tip of the terminal obstructor) lodge forewardly against the ammunition rim ledge or other stop means of the gun, and said activation is accomplished by activation means extending from said obstruction means through the firing chamber and gun barrel to a muzzle stop activator essentially abutting the gun barrel muzzle.

Those skilled in the art who have the benefit of this disclosure will appreciate that it may be used as the creative basis for designing devices or methods similar to those disclosed herein, or to design improvements to the invention disclosed herein; such new or improved creations should be recognized as dependant upon the invention disclosed herein, to the extent of such reliance upon this disclosure.

We claim:

1. A device for preventing discharge of a gun, for insertion into the forward muzzle of the gun and extending rearwardly through the gun barrel, said device comprising:

(a) means for physically obstructing positioning of ammunition in the firing chamber of the gun, said obstruction means comprising a terminal obstructor and a intermediate obstructor, each having a foreward end and an essentially opposite rearward end, both having an essentially cylindrical cross-sectional configuration and at least one cooperating interface that, upon said activation, facilitates lateral displacement of said terminal obstructor relative to said intermediate obstructor resulting in the increase of the combined cross-sectional dimension sufficient for said obstruction means to contact the inner wall(s) of the firing chamber and for said terminal obstructor to lodge forewardly against the ammunition rim ledge of the gun, (1) said intermediate obstructor comprising a right circular cylinder including a foreward closed end with port, and including a rearward end comprising an essentially diagonally truncated interface, (2) said terminal obstructor comprising a right circular cylinder including a rearward closed end having an aperture with a threaded bore, and including a foreward end including an essentially diagonally truncated interface, said diagonal interface having a foremost aspect essentially terminating in an apical facet adapted for lodging forewardly against the ammunition rim ledge of the gun, each of said diagonal interfaces aligning in cooperating relationship so that, when said activation causes said terminal obstructor to travel foreward, said terminal diagonal interface contacts said intermediate diagonal interface, and continues traveling with said activation until said terminal apical facet extends forewardly outside the lateral surface of said intermediate obstructor;

(b) means for activating said physical obstruction means, said activation means comprising (1) a muzzle stop activator including a rotational cylinder in functional communication with said terminal obstructor, (2) a bridge element having a foremost end essentially permanently anchored to said muzzle stop activator and a rearmost end essentially permanently anchored to said foreward closed end of said intermediate obstructor, and (3) an activator rod having an externally threaded foremost end functionally connected thereby to said muzzle stop activator, and an externally threaded rearmost end threaded through said threaded-bore aperture of said terminal obstructor, rotation of said rotational cylinder causing corresponding rotation of said activator rod, in turn causing said terminal obstructor to travel foreward on said external threads, the amount of rotation determining the amount of tension exerted by said obstructor means against the gun; and (c) means for locking said physical obstruction means in said obstructing position, and unlocking same.

2. A device described in claim 1, wherein:

said bridge element is a rigid tube substantially housing said activator rod.

3. A device described in claim 1, further comprising:

an obstructor stop means preventing exiting of said terminal obstructor from said rearmost end of said activator rod.

4. A device described in claim 3, wherein:

said obstructor stop means is selected from the group consisting of the use of a flared activator end, a crimped activator end, at least one terminal roll pin, a terminal lock nut, corrosives, adhesives, and combinations thereof.

5. A device described in claim 3, wherein:

said stop means is a lock nut essentially permanently anchored to said rearmost end of said activator rod.

6. A device described in claim 1, wherein:

said muzzle stop activator includes a locking means.

7. A device described in claim 6 wherein:

said locking means includes a cylinder lock having a removable insertion key, the rotation of which causes rotation of said activator rod, which in turn causes said obstructor to travel foreward, said removal causing said obstruction means to be locked in said obstructing position.

8. A method of making a device described in claim 1 for preventing discharge of a gun, comprising the steps of:

functionally connecting a physical obstruction means to a means for activating said physical obstruction, and a means for locking or unlocking same.

9. A method of making a device as described in claim 5, wherein:

said functional connection of said physical obstruction means is comprised of:

providing a removable key for operation of, insertion within and removal from, a rotary cylinder lock, rotationally connecting a rotary activation cylinder to an activator rod extending through an intermediate obstructor port and threading through a terminal obstructor aperture while terminating with a lock nut, and also attaching a non-rotational portion of said cylinder to a bridge tube substantially housing said activator rod and anchoring said intermediate obstructor.

10. A method of using a device described in claim 1 for preventing discharge of a gun, comprising the steps of:

inserting obstruction means down a gun barrel muzzle, activating said obstruction means, so that said obstruction means prevents the loading of ammunition into the gun firing chamber, and locking said obstruction means in said obstructing position.

11. A method of using a device as described in claim 6, wherein:

said device is positioned so that said activated obstruction means contact the wall(s) of the firing chamber, and said activation is accomplished by activation means extending from said obstruction means through the firing chamber and gun barrel to a muzzle stop activator essentially abutting the gun barrel muzzle.

12. A method of using a device as described in claim 6, wherein:

said device is positioned so that said activated obstruction means lodge forewardly against the ammunition rim ledge, and said activation is accomplished by activation means extending from said obstruction means through the firing chamber and gun barrel to a muzzle stop activator essentially abutting the gun barrel muzzle.

13. A method of using a device as described in claim 6, wherein:

said device is positioned so that said activated obstruction means both contact the wall(s) of the firing chamber and lodge forewardly against the ammunition rim ledge, and said activation is accomplished by activation means extending from said obstruction means through the firing chamber and gun barrel to a muzzle stop activator essentially abutting the gun barrel muzzle.

14. A device for preventing discharge of a gun, for insertion into the forward muzzle of the gun and extending rearwardly through the gun barrel, said device comprising a removable key inserted within a rotary cylinder lock rotationally connected to an activator rod extending through an intermediate obstructor port and threading through a threaded terminal obstructor aperture while terminating with a lock nut, said rotary cylinder lock also attached to a bridge tube substantially housing said activator rod and essentially permanently anchoring said intermediate obstructor, said terminal obstructor including a foreward end including an essentially diagonally truncated interface, said diagonal interface having a foremost aspect essentially terminating in an apical facet adapted for lodging forewardly against the ammunition rim ledge of the gun, the amount of cylinder lock rotation determining the amount of tension of said obstructors against the gun.

15. A device described in claim 3, wherein:

(a) said terminal obstructor is comprised of a right circular cylinder having a rearward closed end and a foreward end comprising an essentially diagonally truncated interface, said closed end defining an aperture having a threaded bore for accepting a rearmost end of said activator rod including external threads acceptable to said threaded bore, said rearmost end of said activator rod having said terminal lock nut essentially permanently anchored thereto, said diagonal interface having a foremost aspect essentially terminating in an apical facet adapted for lodging forewardly against the ledge of the ammunition rim ledge of a gun, (b) said intermediate obstructor is comprised of a right circular cylinder having a foreward closed end, a rearward end comprising an essentially diagonally truncated interface, said closed end essentially permanently anchored to a rearward end of said bridge tube substantially housing said activator rod, said closed end also defining a port for passage of said activator rod;

(c) said rotary cylinder lock accepting said removable insertion key, said cylinder lock having a diameter greater than the bore diameter at the gun muzzle and anchored at a rearward end to a foreward end of said bridge tube anchored to said foreward end of said intermediate obstructor;

(d) said activator rod rotationally connected at a foreward end to said rotary cylinder, extending through said intermediate obstructor port and threading through said terminal obstructor aperture while terminating with said lock nut, the rotation of said rotary cylinder causing corresponding rotation of said activator rod, which in turn causes said terminal obstructor to travel foreward on said external threads;

each of said diagonal interfaces aligns in cooperating relationship so that, when said rotation causes said terminal obstructor to travel foreward, said terminal diagonal interface contacts said intermediate diagonal interface, and continues traveling with said rotation until said terminal apical facet extends forewardly outside the lateral surface of said intermediate obstructor, the amount of cylinder lock rotation determining the amount of tension of said obstructors against the gun; and said key removal causing said obstructors to be locked in said obstructing position.

* * * * *